United States Patent [19]

Kato et al.

[11] 3,995,434

[45] Dec. 7, 1976

[54] WAVE DISSIPATING WALL

[75] Inventors: Hisanori Kato, Tochigi; Hiroshi Okamoto, Kamiinayo, both of Japan

[73] Assignees: Nippon Tetrapod Co., Ltd., Tokyo, Japan; Robert Q. Palmer, Las Vegas, Nev.

[22] Filed: July 29, 1975

[21] Appl. No.: 600,008

[30] Foreign Application Priority Data

Aug. 8, 1974 Japan ..... 49-90300

[52] U.S. Cl. ..... 61/4; 52/607; 52/611

[51] Int. Cl.[2] ..... E02B 3/06

[58] Field of Search ..... 61/4, 5, 39, 49; 52/303, 663, 505, 607, 611

[56] References Cited

UNITED STATES PATENTS

| | | | |
|---|---|---|---|
| 905,596 | 12/1908 | Smith | 61/4 |
| 2,184,462 | 12/1939 | Miliken | 61/4 |
| 2,892,340 | 6/1959 | Fort | 61/39 |
| 3,280,569 | 10/1966 | Wosenitz | 61/4 |
| 3,894,397 | 7/1975 | Fair | 61/4 |

*Primary Examiner*—Paul R. Gilliam
*Assistant Examiner*—Alex Grosz
*Attorney, Agent, or Firm*—Flynn & Frishauf

[57] ABSTRACT

A wave dissipating wall is formed of a plurality of wave chambers comprising a plurality of horizontal plates and vertical partition walls opening toward the direction from which waves come in. The ends of the walls dividing the chambers are wider than the remaining parts of the walls and the front walls comprise semi-circular curved surfaces extending toward the direction from which the waves come in order to introduce the waves into the chamber having a wider width than the entrance formed between the respective front walls and to let the waves circulate within the chamber by the energy of the waves, thereby increasing the friction resistance between the waves and the walls as much as possible and achieving an efficient diminishing of the wave energy.

16 Claims, 6 Drawing Figures

WAVE DISSIPATING WALL

The present invention relates to a wave dissipating wall to diminish wave action in ports and harbors without hindering the ship loading and unloading operations at the wall.

There are many examples of vertical bulkhead walls used along the periphery of ports. Generally speaking, any vertical surface reflects incoming waves impinging on the surface. The combined amplitude of the incident and reflected wave form standing waves of nearly twice the amplitude of the incident wave. Such waves disturb the calmness in the port and lower the loading and unloading efficiency. In view of such disadvantages, there have been made several attempts to lower the reflection ratio of waves of the vertical bulkhead walls.

The wave dissipating wall in accordance with this invention aims at improving hydraulic functions and workability of conventional type vertical structures and at obtaining more advantageous vertical structures.

It is known in the art to diminish the wave energy by letting the waves crash onto some special structures and to cause the loss of energy through friction as the waves flow along the surface of the said structures. However, such a method as above mentioned is usually practiced in the form of a wave dissipating embankment which is formed of a plurality of concrete blocks by piling them on the beaches and coast so as to prevent the destruction or erosion of the same by the wave energy. There have been found no examples where such a structure was applied to the vertical wall where the cross section of the wall could not be increased without limitation.

When the wave energy is lost through the friction caused by the waves as they become a horizontal flow and flow alongside the various parts of the structure such as a block, the energy loss increases proportionate to about 2 to 3 times of an average flow rate. Accordingly, the most desirable way of losing the wave energy effectively is to let the waves flow along the surface of a structure for the longest practical distance of the greatest practical surface area at a fastest practical speed. Concurrently, energy is dissipated by turbulence caused by directing a counter flow into the center of chambers of the wall and by flow through ports between chambers in levels above and/or below. The theory as above outlined for letting the wave energy diminish was applied to the port structure having specific features such as a vertical wall.

SUMMARY OF THE INVENTION

The object of the present invention is to provide a wave dissipating wall, which is a vertical type and therefore whose cross section cannot be increased beyond a certain limit, with an effective wave energy diminishing action as above outlined for maintaining the calmness within the ports and harbours. There are provided curved front walls at the front of the wall spaced apart from each other to let the water come in, and in the back of which are formed chambers having a wider width than that of the said entrance. The waves are transformed to high velocity jets as they come through a narrow entrance, which then circulate within the said chamber in a spiral fashion so that the friction caused by the contact of the rotating flow with the walls of the chamber and the turbulence would increase, thus causing the energy losses.

Another object of this invention is to provide concrete blocks with which it is possible to construct simply a wave dissipating wall having chambers wherein the wave energy may be diminished by introducing the waves into those chambers. For this purpose, respective blocks have semi-circular front walls and rear walls having a greater width than the said front walls which are connected to the said front walls by thin partition walls and horizontal plates having the same width as that of the rear walls and integrally formed with all these walls.

DESCRIPTION OF PREFERRED EMBODIMENTS

Figure 1:
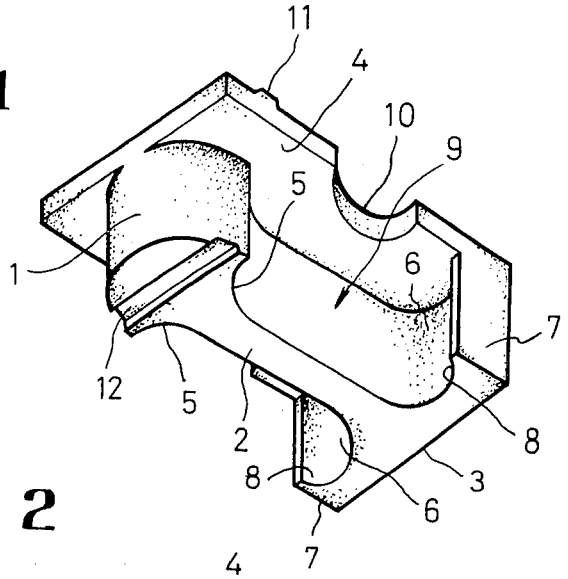
FIG. 1 is a perspective view of concrete block seen from the bottom for constructing the wave dissipating wall in accordance with the present invention.
Figure 2:
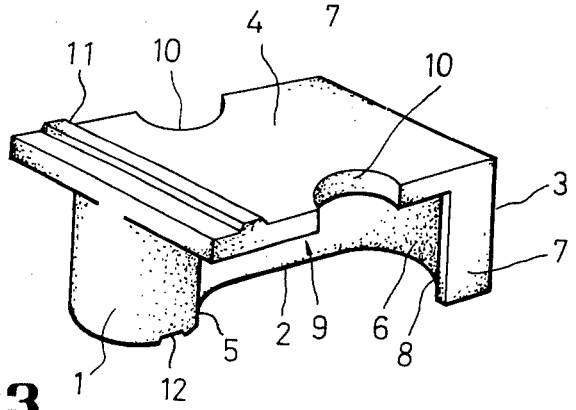
FIG. 2 is a perspective view seen from the top of the concrete block of FIG. 1.
Figure 3:
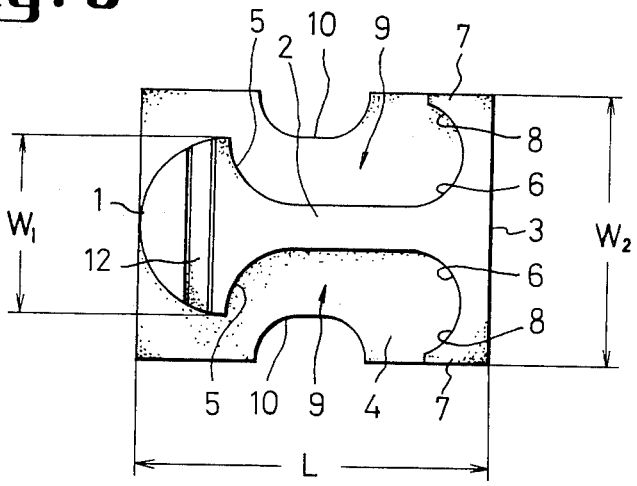
FIG. 3 is a bottom view of the block of FIG. 1.

FIGS. 1, 2 and 3 illustrate a concrete block used as the construction material for the wave dissipating wall in accordance with the present invention. This block comprises the front pillar 1, the partition wall 2, the rear wall 3 and the horizontal plate 4 placed on top of these walls. The front pillar 1 is semicircular in cross section, its convex part facing the direction from which the waves come in. In the rear center of the said front pillar 1 is the partition wall 2 extending to the rear. The said partition wall 2 has a thickness of about less than one-fourth of the width $W_1$ of the front pillar and joins with said front pillar 1 via the curved surfaces 5. The rear wall 3 is formed at the rear end and is perpendicular to the partition wall 2 in such a way that said walls 2 and 3 resemble the letter "T". The width $W_2$ of the rear wall 3 is wider than the width $W_1$ of the front pillar 1, the ratio between the two being 3 : 2. There is also provided a curved surface 6 at both ends of the part joining the said partition wall 2 and the rear wall 3. At the two ends of the said rear wall 3 are provided projections 7 extending toward the front wall, the said projections 7 having curved surfaces 8 joining the said curved surfaces 6 respectively. Thus, the partition wall 2 has, on its both sides, circulating water passages 9 having the periphery comprising the curved surface 5 at the rear of the front wall, one wall of the partition 2 and the curved surfaces 6, 8 of the said rear wall respectively in an approximately oval shape with a section missing thereform like a notch. The horizontal plate 4 is provided on the front wall 1, the partition 2 and the rear wall 3 to form an integral part of these walls, the width thereof being the same as that of the rear wall, $W_2$, and the length, L, thereof being sufficient for spanning the said rear wall 3 and the front wall 1.

About midway of the outer periphery of plate 4 and on each side thereof are notches 10. There is provided an engagement ridge 11 toward the front of the upper side of said horizontal plate 4 in parallel to the axial line of the rear wall 3, while there is an engagement groove 12 at the lower side of the said front wall 1 to engage the projection or ridge 11 of another block.

Figure 4:
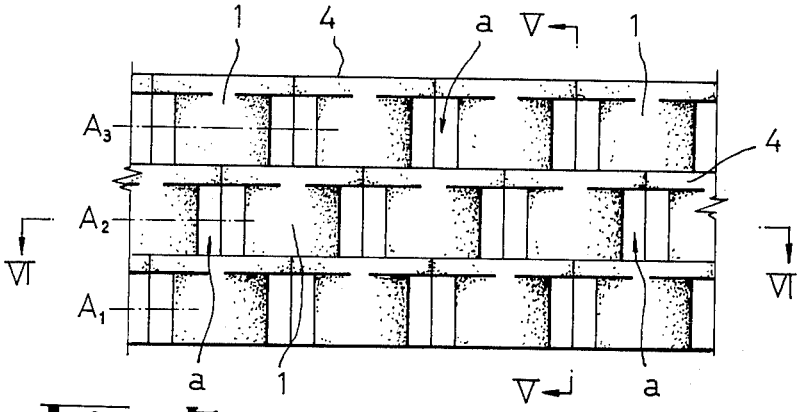
FIG. 4 is a front view of a part of the wall which is formed by stacking the concrete blocks.
Figure 5:
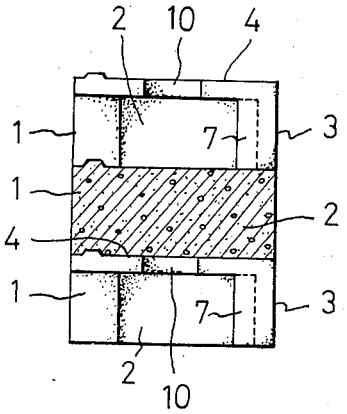
FIG. 5 is a cross section along the line V — V of FIG. 4.

The concrete blocks as above described are arranged and stacked on top of each other in an arrangement shown in FIGS. 4 and 5. Each of the blocks is positioned so that the front pillar 1 would face the direction from which the waves come in and the horizontal plate 4 would come at the top of the blocks arranged adjacent to each other to comprise the first block row $A_1$ (FIG. 4). On the horizontal plate 4 of the respective blocks in this block row $A_1$ are placed the second block row $A_2$ arranged similarly and in such a way that the front pillars 1 of the respective blocks in the said row $A_2$ would be directly above the joint between two adjacent blocks in the lower block row $A_1$ and further the ridges 11 and the grooves 12 would engage with each other. On top of the said block row $A_2$ is placed another block row $A_3$ arranged similarly as the said block row $A_1$ and so forth until a wall is constructed by these blocks.

Figure 6:
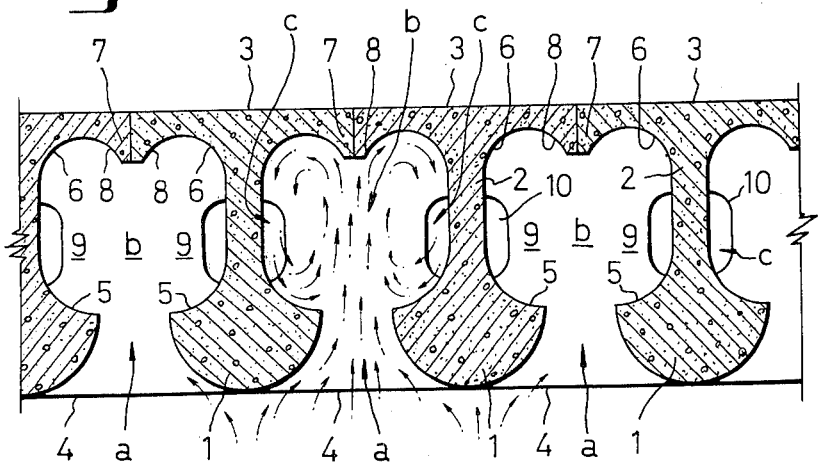
FIG. 6 is a cross section along the line VI — VI of FIG. 4.

The wave dissipating wall in accordance with the present invention has the structure as above described and the wall constructed by arranging the said blocks form entrances *a* (FIG. 6) at the front in the direction from which the waves come in to let the waves flow into the blocks by the semi-circular curved surfaces of the said front pillars 1 between these front pillars 1. Between the blocks at each block row are formed the water chambers *b* each having width wider than that of the said entrance *a*, the said chambers *b* being formed by the horizontal plates 4 of the blocks in the lower level and the partition walls 2 and the rear walls 3 of the adjoining blocks as shown in FIG. 6. The notches 10 in the horizontal plates 4 also form a ports *c* to connect the upper and lower block levels.

The incident waves would first crash onto the front pillars 1 of the vertical wall as above constructed and then flow into the chambers *b* through entrances *a* along the curved surface of the said pillars 1. At that time, the incident wave is transformed into a horizontal flow from an orbital motion by the action of the horizontal plates 4. Because of the curved front surfaces, the front pillars 1 do not reflect the waves but guides them into the entrances *a*, and the flow forms a jet as it passes through the entrances *a* which has a narrower width than that of the respective front pillars 1. Thus, the water advances toward the rear wall 3 within the chamber *b* at the rear of the entrance *a*. The portion of the rear wall 3 upon which the water crashes is where the two blocks join each other and there are two projections 7 having curved surfaces 8 respectively at the ends of the rear walls of the blocks extending toward the direction of the entrance *a* like a wedge. The water advancing across the chamber *b* would be diverted to the right and left by the curved surfaces 8 on both sides of these projections as it crashes against the rear wall 3 and as shown by an arrow in FIG. 6. The flows thus diverted at the rear of the chamber would flow along the curved surface 6 at the joint of the partition wall 2 and the rear wall 3, along the wall surface of the partition wall 2 toward the front pillar 1 and before it is discharged out of the entrance *a*, the direction is again changed by the curved surface 5 at the back of the front wall 1.

As the flows above mentioned are caused symmetrically at the two circulating passages 9 formed by the curved surfaces 5, 6 and 8 respectively on both sides of a water chamber *b*, the waves of which the direction has been changed by the curved surfaces 5 at respective circulating passages 9 join together at the back of the entrance *a* to flow toward the rear wall 3 once again. Because the flow of the water such as the above has an extremely fast flow rate, the water at the two circulating passages 9 within the water chambers *b* circulates in spirals as indicated by arrows, increasing the friction resistance with the blocks in the water chamber *b*, thereby diminishing the energy of the flow. Such flows are seen not only within the individual chamber but also in the ports *c* formed by the notches 10 of the horizontal plate 4 of the blocks, and connecting chambers in the upper and lower levels. A part of the water flowing within the individual chambers would advance into these other chambers to disperse and to rapidly diminish the wave energy coupled with the said circulating motion within the water chambers.

As above explained, the wave dissipating wall in accordance with the present invention provides a narrow entrance *a* between respective front pillars 1 and a water chamber *b* having a greater width than the said entrance *a* at the rear by suitably arranging the blocks having semi-circular front pillars 1, the partition wall having approximately less than one-fourth of the width at the back of the said wall, a wide rear wall 3 of which width is greater than that of the front pillar 1 in a ratio of 3 : 2 and a horizontal plate 4 having the same width as that of the rear wall, and also an oblong circulating passage 9 formed by the curved surfaces 5, 6 and 8 and the side walls of the partitions. A portion of plate has been notched to form ports *c* to permit flow between upper and lower chamber levels to further dissipate energy. The flow rate of the horizontal flow induced by the entrance *a* into the water chamber *b* without causing reflection is accelerated and the said flow is circulated as in a spiral so that an efficient diminishing of the wave energy within a narrow confined space is achieved. Thus, compared to various types of vertical walls, the invention proves most advantageous with its high wave dissipating efficiency and economical cost.

What is claimed is:

1. A wave dissipating wall comprising means defining a plurality of water chambers arranged in side-by-side and in vertically stacked relationship to form at least two levels of chambers, each of said chamber defining means comprising:

a pair of spaced substantially horizontal plate-like members, each having front and rear portions;

at least one rear wall extending substantially vertically between the rear portions of said horizontal plate-like members to define a rear wall of a chamber, said plate-like members defining the upper and lower surfaces of said chamber;

a plurality of spaced apart substantially vertical partition walls extending between said two plate-like members from said rear wall towards the front portions of said plate-like members, said partition walls being each connected to said rear wall and defining respective curved corners with said rear wall, said curved corners being directed inwardly of said chamber; and means defining an entrance opening at said front portions of said plate-like members, said entrance opening defining means comprising at least two spaced apart substantially vertical front pillars extending between said plate-like members and having convex surfaces which face away from said rear wall and extend outward in the direction from which waves approach, said front pillars being connected at the forward ends of respective partition walls and defining respective curved corners with said respective partition walls, said curved corners of said front pillars being directed inwardly of said chamber so as to cooperate with said rear wall, partition walls and front pillars to define at least one circulating flow path in said chamber, whereby water entering said chamber provides substantially continuous circulation around said at least one flow path to dissipate wave energy;

said front pillars each having a width such that the width of the entrance opening defined between adjacent front pillars is less than the width of the water chamber defined between adjacent spaced apart partition walls.

2. A wave dissipating wall according to claim 1 wherein said convex surfaces of said front pillars are generally semi-circular surfaces.

3. A wave dissipating wall according to claim 1 wherein said curved corners are generally arcuate in shape.

4. A wave dissipating wall according to claim 1 wherein at least one of said plate-like members has a cut-out notch therein for providing a substantially vertically directed flow passage between vertically adjacent chambers of said at least two levels of chambers.

5. A wave dissipating wall according to claim 4 wherein at least two chambers of two adjacent levels use a common plate-like member to define at least a portion of the respective upper and lower surfaces thereof.

6. A wave dissipating wall according to claim 1 wherein at least two chambers of two adjacent levels use a common plate-like member to define at least a portion of the respective upper and lower surfaces thereof.

7. A wave dissipating wall according to claim 1 wherein said rear wall has at least one projection therein extending toward said entrance opening so as to cooperate with said rear wall, partition walls and front pillars to define at least two circulating flow paths in said chamber.

8. A wave dissipating wall according to claim 7 wherein the transition between said at least one projection and said rear wall is a curved surface.

9. A wave dissipating wall according to claim 1 wherein said chambers are arranged such that the chambers of one level are centered between the chambers in the level below so that the entrance openings of said chambers of alternate levels are staggered.

10. A wave dissipating wall according to claim 1 wherein said chamber defining means comprises a plurality of blocks adapted to be located horizontally and vertically adjacent each other, each block comprising:

a substantially horizontal plate-like member having front and rear portions;

a rear wall portion extending substantially vertically from the rear portion of said plate-like member;

a substantially vertical partition wall extending from said plate-like member in the same vertical direction as said rear wall and extending from said rear wall toward the front portion of said plate-like member; and a front pillar at said front portion of said plate-like member and extending substantially vertically from said plate-like member in the same direction as said rear wall and partition wall, said front pillar having a width in a direction perpendicular to the running direction of said partition wall which is less than the width of the rear wall, the plate-like member having substantially the same width as that of the rear wall, said horizontal plate-like member, said front pillar, said partition wall and said rear wall being integrally formed.

11. A wave dissipating wall according to claim 10 wherein said partition wall is located substantially centrally, in the horizontal direction, of said front pillar and of said rear wall, said block defining at least part of two horizontally adjacent channels of said wave dissipating wall.

12. A wave dissipating wall according to claim 10 wherein the corners joining the front pillar and the partition wall, and the partition wall and rear wall, have curved surfaces which are curved inwardly toward the chambers defined by said wall.

13. A wave dissipating wall according to claim 10 wherein said plate-like member has at least one cut-out notch therein for providing a substantially vertically directed flow passage between vertically adjacent chambers.

14. A wave dissipating wall according to claim 13 wherein said plate-like member has cut-out notches on both sides of said partition wall.

15. A wave dissipating wall according to claim 10 wherein a groove is formed at the lower portion of the front pillar and a ridge is formed across the top surface of said plate-like member, said blocks being adapted to be vertically stacked and be arranged adjacent each other with the grooves of an upper block engaging the ridge of a lower block.

16. A wave dissipating wall according to claim 10 wherein the front surface of said front pillar is convex in the direction from which waves approach.

* * * * *